US011445798B2

(12) United States Patent
Brilland et al.

(10) Patent No.: US 11,445,798 B2
(45) Date of Patent: Sep. 20, 2022

(54) COSMETIC UNIT WITH SHELL ON DEMAND

(71) Applicant: GEKA GmbH, Bechhofen (DE)

(72) Inventors: Arnaud Brilland, Bechhofen (DE); Friedrich Weigel, Bechhofen (DE); Sacha Cusseau, Bechhofen (DE); Hayden Turner, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 17/417,010

(22) PCT Filed: Dec. 19, 2019

(86) PCT No.: PCT/EP2019/086442
§ 371 (c)(1),
(2) Date: Jun. 21, 2021

(87) PCT Pub. No.: WO2020/127823
PCT Pub. Date: Jun. 25, 2020

(65) Prior Publication Data

US 2022/0071372 A1 Mar. 10, 2022

(30) Foreign Application Priority Data

Dec. 19, 2018 (EP) ..... 18214220

(51) Int. Cl.
*A45D 34/04* (2006.01)
*A45D 40/26* (2006.01)
*A45D 34/00* (2006.01)

(52) U.S. Cl.
CPC ..... *A45D 34/045* (2013.01); *A45D 40/265* (2013.01); *A45D 2034/007* (2013.01)

(58) Field of Classification Search
CPC .... A45D 34/04; A45D 34/041; A45D 34/042; A45D 34/043; A45D 34/045; A45D 34/046; A45D 40/26; A45D 40/261; A45D 40/262; A45D 40/264; A45D 40/265; A45D 40/267; A45D 2034/007
USPC ..... 401/126–130
See application file for complete search history.

(56) References Cited

U.S. PATENT DOCUMENTS 6,132,123 A * 10/2000 Gueret ..... B65D 23/001 401/48
6,966,716 B2 * 11/2005 Pink ..... A46B 5/02 401/6
8,882,381 B2 * 11/2014 Nobles ..... A45D 40/18 401/129
2010/0181224 A1 7/2010 Kuo
2018/0352935 A1 12/2018 Lin

FOREIGN PATENT DOCUMENTS

FR 2920650 A1 3/2009

* cited by examiner

*Primary Examiner* — David J Walczak

(57) ABSTRACT

Cosmetic unit (1) comprising a container (2) filled with a flowable cosmetic that can be removed through an access opening of the container (2), and a cap (3) for closing the access opening of the container (2), whereas the cap (3) carries an applicator (17), wherein the container (2) is formed by a tank (12) made of cosmetic compatible material and a rigid outer shell surrounding at least the tank (12).

13 Claims, 8 Drawing Sheets

COSMETIC UNIT WITH SHELL ON DEMAND

The invention concerns a cosmetic unit according to the generic portion of the claims and a method for manufacturing such a cosmetic unit.

TECHNICAL BACKGROUND

For the successful sale of a cosmetic unit the outer design of the cosmetic unit becomes more and more important.

Normally, cosmetic units are made by injection moulding or blow moulding. The mould receiving the injected or blown-in plastic material pictures the desired three dimensional surface structure of the cosmetic unit.

There is an increasing need for cosmetic units having a design on demand or at least for special editions which can be produced as small batches very quickly, for example in order to be promoted at the occasion of special events like the concert of a celebrated pop star who is well known for her or his extravagant makeup.

To manufacture a special injection mould or blow mould just in time for the event is too slow and in most cases too costly.

Internally thought has already been given to manufacture the required cosmetic unit by means of 3D-printing. However, at that occasion 3D-printing turned out as being no means of choice since a unit for storing cosmetic mass over a longer period of times needs to be manufactured out of a material for which it can be granted.

Moreover, it is quite often difficult to print a tank that is really tight and fully sealed when closed.

On the one hand the porous structure of a 3D-printed material turned out as a problem at this point. On the other hand the pre-processing of the 3D-printing files is surprisingly often not perfect. At all points, all corners and all transitions where the wall of the container defined by virtual lines and virtual area elements (like an interplay of sections of plates, cylinders and cuboids), is not perfectly modelled, at least micro-tightness can be missing. This turns out to be a particular problem where printing out of a cosmetic container is desired on an end user's demand and on the basis of a CAD-file uploaded by the end user.

OBJECT UNDERLYING THE INVENTION

It is the object of the invention to make cosmetic units available which offer a variety of design options and which can be efficiently and securely manufactured at low costs and in short time even if the edition comprises a small series of such cosmetic units only.

The Inventive Solution

The inventive solution is provided by means of the features of claim 1.

The cosmetic unit comprises a container. Said container is filled with a flowable cosmetic, namely a liquid, viscous, creamy or powdery cosmetic mass, which may be a lip balm or a mascara mass in particular.

Said cosmetic mass can be removed through an access opening of the container. The cosmetic container is closed by means of a cap for closing the access opening of the container. In most cases the cap provides a flexible sealing element for a hermetical sealing when being fixed in closed position.

The cap carries an applicator which can be stuck into the container and which can be dipped into or loaded with the cosmetic mass stored inside the container. This way, the applicator is capable to apply the cosmetic mass after having been withdrawn from the container.

According to the invention, the container is formed by a tank made of cosmetic compatible material and a rigid outer shell surrounding at least the tank.

A cosmetic compatible material in the sense of the invention is a material that does not allow (in no case or not substantially) components or ingredients of it, such as softeners, hardeners etc. to migrate into the cosmetic mass stored inside the tank made of this material. Moreover it is resilient against taking up and failing under the influence of fats, waxes and/or alcohols being components of cosmetic masses. In some cases a cosmetic compatible material is in addition only such a material that hinders volatile components of the cosmetic mass from substantially escaping through the walls of the tank by means of diffusion. The tank is normally an injection moulded or a blow moulded part with a flat jacket. It can be equipped with an inside or outside diffusion barrier by means of an appropriate coating, for example. In particular, the jacket of the tank normally does not exhibit a three-dimensional decoration, apart from one or more grooves, for example, that do not serve for decoration, but which are provided for technical reasons, as fixation means and/or centring means for example.

The tank is surrounded by a rigid outer shell which provides for the desired 3D decoration like, for example, a relief with one or more Latin characters representing the trademark or company name of the corporation, under whose authority the product is manufactured and distributed. Likewise, any other decoration in the shape of a relief can be provided by the shell, like, for example, a decoration that gives the impression of a birch wood branch with its silvery bark or a rose bud beginning to blossom.

Here, rigid does not mean brittle like glass. Instead, it has a rather broad meaning. In any case "rigid" means that the shell is too tough for more than punctual creasing like a sleeve made of a thin plastic or metal film exhibited.

Normally, the major part of the circumferential jacket of the tank is hidden by said shall since the shell—even if exhibiting a mesh-like or framework-like structure only—fully surrounds the circumferential jacket of the tank, maybe except of its bottle-neck portion that may extend out of the shell, at least as long the container is opened for use.

This construction has the enormous advantage that the tank may be manufactured with standard blow moulding or injection moulding tools that exist already and that do not need to show the complicated structure that would be otherwise necessary to picture the 3D-relief that is desired to produce the necessary decoration effect.

Moreover, the material of the tank can be consequently chosen to fulfil the requirements of chemical and mechanical durability.

This allows to choose a material for the shell that is optimized for a quick and precise 3D-printing process and for exhibiting the desired decorativeness—without any consideration of the question whether the chosen material would be fully and lastingly compatible with the cosmetic mass to be stored within the container.

Finally, the designer's freedom for creativity is significantly increased by the invention since the designer is not any more bound to the restraints of blow moulding or injection moulding—which are both manufacturing processes that do not or rarely allow undercuts or accumulations of material.

Preferred Embodiments of the Invention

A preferred embodiment provides that the shell forms a framework with interspaces or "windows" through which the tank can be seen from outside, while the tank is preferably metallized or transparent or translucent.

The—preferably regular or following a regular pattern—distributed provision of such interspaces all over the major part of the jacket surface leads to significant speeding up of the printing process since the volume of the material to be fused during printing decreases.

Moreover, said interspaces can very easily generate an interesting design pattern, for example if the tank has a metallic or metalized jacket surface. Alternatively, the shell may show a macroscopic texture of solid particles fused together.

Preferably, the shell accommodating the tank has no closed bottom below the tank. This design leads to a remarkable saving in printing time, too. Moreover, it can make the detachment of the tank much easier, which is important if the system is provided for refill or if the user feels the need to use another shell (colour, design being tuned to outfit) night after night.

In some cases it is an attractive option to print the outer shell onto the tank. The tank is thereby serving as a base structure for 3D-printing. That way a reliable 3D-manufacturing process can be started very quickly.

In the aforementioned case the wall of the container is chosen thick enough to bear its local melting by a laser beam. Preferably, the surface material of the container and the 3D-printing granulate are matched to one another in such a way to one another so that the surface material and the 3D-printing granulate fuse together if locally melted while resting upon another.

In the framework of another preferred embodiment it is provided that the tank forms a bottleneck for holding the cap belonging to the container in a fluid tight position, whereas the cap preferably carries a rigid outer shell, too.

In terms of consumer acceptance it is highly preferred to care for a comfortable possibility of tank replacement without endangerment of the user's finger nails, without forcing the user to fetch a tool normally not being at hand and without exposing the user to the danger of unintentionally spilling the container's contents.

For that reason, it is recommended to design the interconnection between the tank and the shell and/or the cap and the shell as a form fit latching that can be locked and released by the user without leaving any traces or scratches at the cosmetic unit.

That implies that means are provided which allow the user to actuate said latching without any levering or wedging by means of a screw driver, a knife or a scissor blade.

It is highly recommended to realize the form fit latching as by at least one internally hidden latch which is remotely actuated.

If the latch is internally hidden, it does not impair the aesthetic outer appearance.

Preferably, the shell surrounding the tank and/or the cap is equipped with an actuation hole through which a pin or rod can be introduced into the shell for contacting and operating the said at least one internally hidden latch.

Alternatively, said shell is equipped with a movable shell portion preferably in the shape of a movable collar or slider that can be moved deeper into the shell for contacting and operating said at least one internally hidden latch interacting with the tank or the cap.

Another facultative alternative is that the shell is equipped with a movable shell portion. The movable shell portion is preferably embodied in the shape of a movable collar or slider. Said collar or slider can be moved as a whole relatively to the rest of the shell, that way acting itself as an internally hidden latch.

LIST OF FIGURES

FIG. 1 discloses a first version of the outer shell design.

FIG. 2 discloses a second version of the outer shell design, here preferably in the shape of spring-like web.

FIG. 3 discloses a third version of the outer shell design.

FIG. 4 discloses a fourth version of the outer shell design.

FIG. 5 discloses a fifth version of the outer shell design.

FIG. 6 discloses the application unit being equipped with a first locking mechanism, after removal of the complete cap.

FIG. 7 discloses the cap with its applicator completely pulled out of the tank.

FIG. 8 discloses the cosmetic unit as a whole.

PREFERRED EMBODIMENTS OF THE INVENTION

First Design of the Shell

Figure 1:
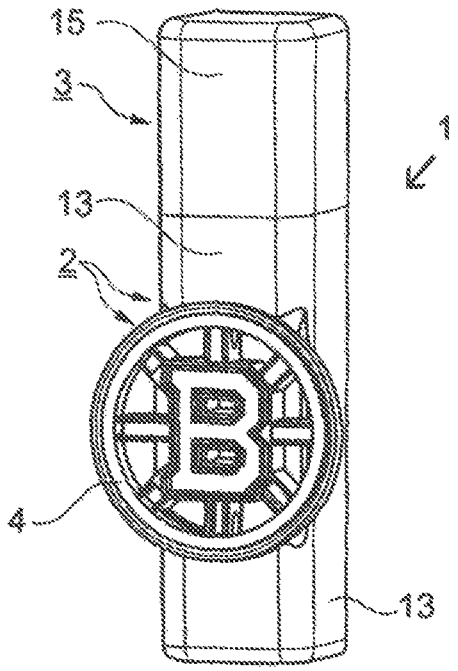

FIG. 1 shows the first preferred embodiment according to the invention.

The inventive cosmetic unit 1 is formed rather similar as known cosmetic units. It consists of a container 2 and a cap 3 for closing the container 2.

The container 2 is formed by a tank and a lower rigid shell portion 13 surrounding the tank. The tank is hidden by the lower shell portion 13 and cannot be seen from the outside. The tank serves for securely and lastingly storing the cosmetic mass to be applied.

The cap 3 is formed by a base body, which not visible in FIG. 1, and an upper rigid shell portion 15 surrounding it.

In this case, the lower rigid shell portion 13 is characterized by the additional ornamental design 4. The ornamental design 4 forms a number of undercuts toward the adjacent container 2. A similar ornamental design could also be provided at the cap 3 or at the other lateral surfaces of the container 2.

Second Design of the Shell

Figure 2:
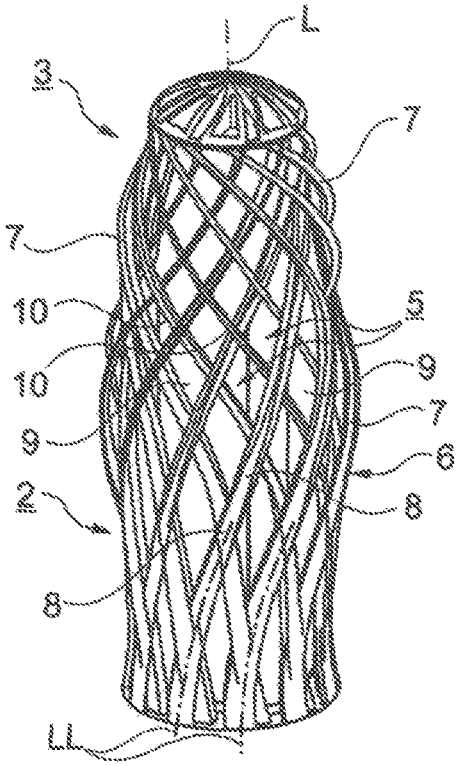

FIG. 2 shows a second, very exciting embodiment according to the invention.

Here, the shell has lost the smooth design it had in FIG. 1. In fact, sometimes an inner portion 5 of the shell is provided. It could be designed as a closed shell portion surrounding the container and the base body of the cap. Maybe the inner shell portion 5 is similar like the shell embodied by the upper shell portion and the lower shell portion shown by FIG. 1, but without the ornamental design 4.

The outermost portion 6 of the shell carried by this embodiment is designed according to FIG. 2. It may be represented by a framework of beams 7, what is a very preferred embodiment. In a number of cases the longitudinal axis LL of the beams 7 cross. Spoken in greater detail, one can say that one provides two fields of beams 7 with parallel longitudinal axes LL, whereas each beam 7 of one field crosses a number of beams 7 of the other field. Wherever two beams 7 cross, they form a node 8. Where a node 8 is embodied, the two crossing beams are preferably fixed to each other. Ideally two crossing beams are melted or fused with each other or a uniform part. In a very preferred embodiment, each beam 7 shows a longitudinal axis LL that curves over a first portion of the beam in one circumferential direction and over a second portion of the beam in the opposite circumferential direction, see FIG. 2.

Preferably, the beams 7 are positioned, solely or additionally, along the greater part of their length with a radial distance D (see FIG. 4) of at least 1 mm, better of at least 3 mm apart from the inner shell portion 5. That way an undercut is formed between the beams 7 and the inner shell portion 5.

Preferably, the beams 7 show a convex curvature in their radial outward direction between their uppermost and their lowermost end. Preferably, the beams 7 leave a pattern of preferably rhombic windows 9 between one another. Ideally, the framework of the beams 7 is elastic so that the beams 7 can be elastically deformed without losing their defined shape, and without crinkling or creasing anyhow. Then the framework of the beams 7 form more or less a web of leaf springs. This web allows a certain compression, mostly of more than 1 mm, by means of the hand of the user. This compression can take place without exerting forces that exhibit an uncomfortable haptic impression. That generates a haptic behaviour that is very attractive and that improves the handling comfort during application.

As can be clearly seen from FIG. 2, the topmost part of the outer shell portion is formed by a number of beams, too. Said beams form a kind of roof in the star-like configuration here the nonvisible bottom can be designed similarly. This arrangement may form a spring element, as explained in greater detail at a later stage.

Even if this feature cannot be clearly seen in FIG. 2 since it may be essentially hidden when the container is fully closed, each of the beams has a cut 10. The cut 10 is positioned in the plane which forms the separation plane between the tank 12 and the base body 14 of the cap. In the area of said cut 10 normally an inner centring ring (not shown here) is provided which supports the free ends of the beams 7 against the base body of the cap or against the jacket of the tank.

Another aspect of this modification can be not to provide a complete inner portion 5 of the shell covering the tank as well as the base body of the cap. Instead, for example, the inner portion of the shell can be reduced to a cylindrical flange portion holding the container, while the rest of the container or the major part of the container freely protrudes into the space being free inside of the framework of the beams 7. In this case it is preferred if the container is made of metal, or if the container is made of plastic with a metalized surface, so that an attractive shimmer or reflection shines out of the windows 9.

In most cases the tank is hold in a fashion that allows a loosening, pulling out, and a replacement, for example by another tank.

In other cases it is desired to make the manufacturing as easy as possible, regardless what happens if the container is empty. In these cases it is very attractive to provide no or essentially no inner portion 5 of the shell. Instead, the framework of beams 7 is directly printed onto the tank and/or the base body of the cap. That way it is made sure in most of these cases that the framework of beams 7 is glued or fused to the outer surface of the tank, where the beam 7 directly contacts the tank. This alternative design is not shown by FIG. 2 here.

Third Design of the Shell

Figure 3:
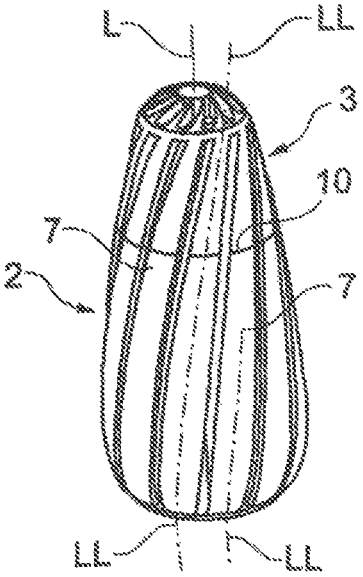

FIG. 3 shows a third embodiment according to the invention that is very exciting, too. There is a close relationship between this design and the design disclosed by FIG. 2. For that reason, all things that have been disclosed together with FIG. 2 apply in regard to the disclosure of FIG. 3, too, as long as something different has not been explicitly communicated or as long as something different is not clearly excluded due to the visible difference of the designs.

The difference is that the beams 7 are broader in circumferential direction compared to the beams 7 used by the construction of FIG. 2. Moreover, another difference is that adjacent beams 7 are preferably not linked to each other by means of nodes 8. In this case the longitudinal axes LL of all beams 7 run parallel or essentially parallel, or side to side, so that the beams 7 do not cross.

Fourth Design of the Shell

Figure 4:
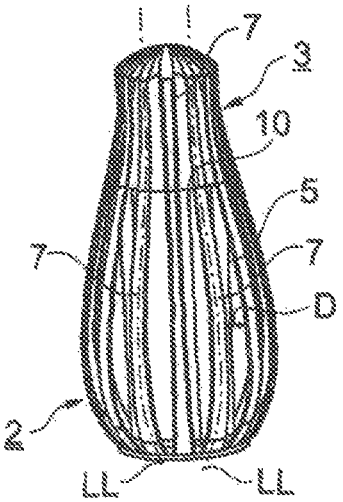
Figure 5:
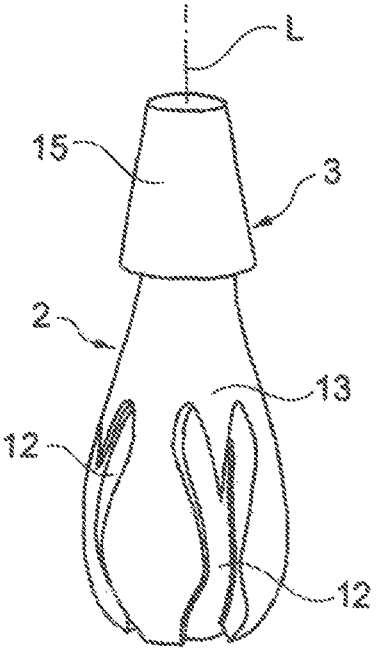

FIG. 4 shows a fourth embodiment according to the invention. This embodiment is rather similar to the embodiment shown by FIG. 3. Moreover, there is a close relationship to the embodiment shown by FIG. 2. Therefore, all things disclosed in connection with FIG. 2 and FIG. 3 apply to this embodiment, too.

What can be seen rather clearly is that the outer shell comprises a bottom to which the ends of the beams 7 are linked, glued, fused, merged or integrally formed. What can be rather clearly seen, too, is the radial distance D between the outwardly curved beams 7 and the inner shell portion 5 that can be observed along the major part of each beam 7.

A very important issue in regard to consumer acceptance of the new system is to find a mode for replacing the tank. Therefore, some different approaches are described next for providing an invisible and reliable solution for a fixation of the tank which can be easily locked and unlocked.

Fifth Design of the Shell

Here the outer shell, more exactly the lower part 13 of the outer shell possesses only local breakthroughs through which the tank 12 is visible. The tank is a design element in this case.

First Fixing Option

The first alternative for latching for example the tank is disclosed by FIGS. 6 to 11.

Figure 8:
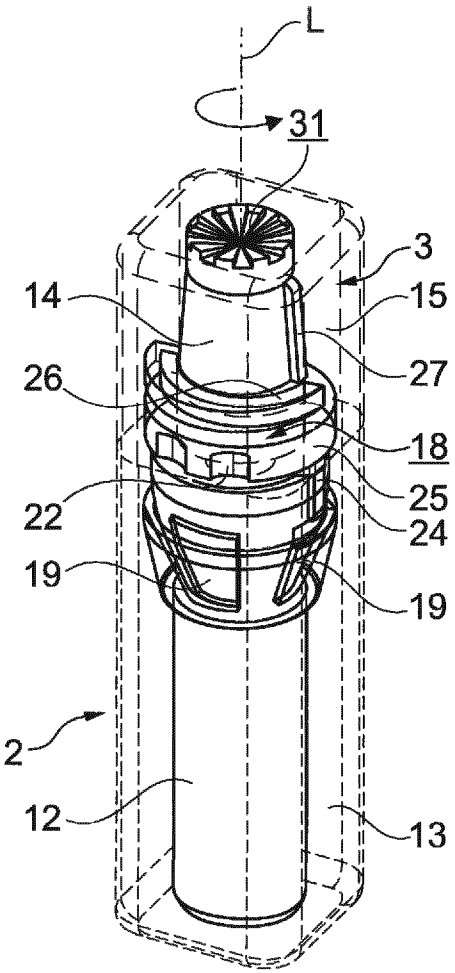
Figure 7:
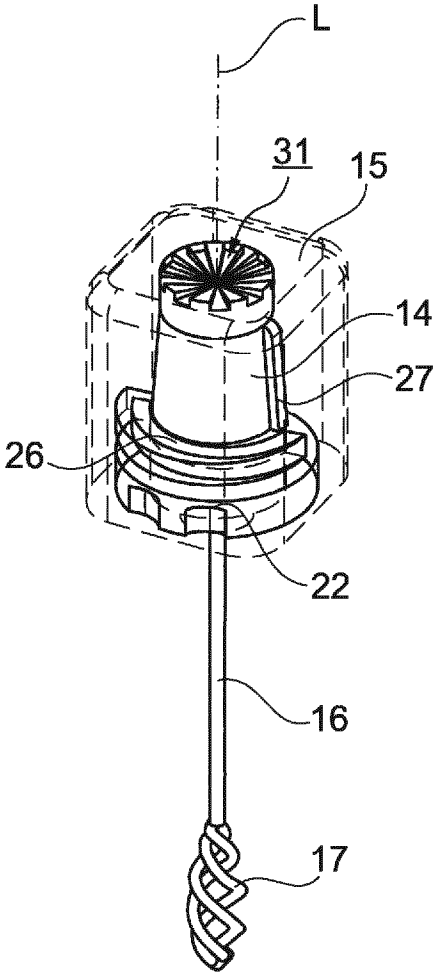
Figure 6:
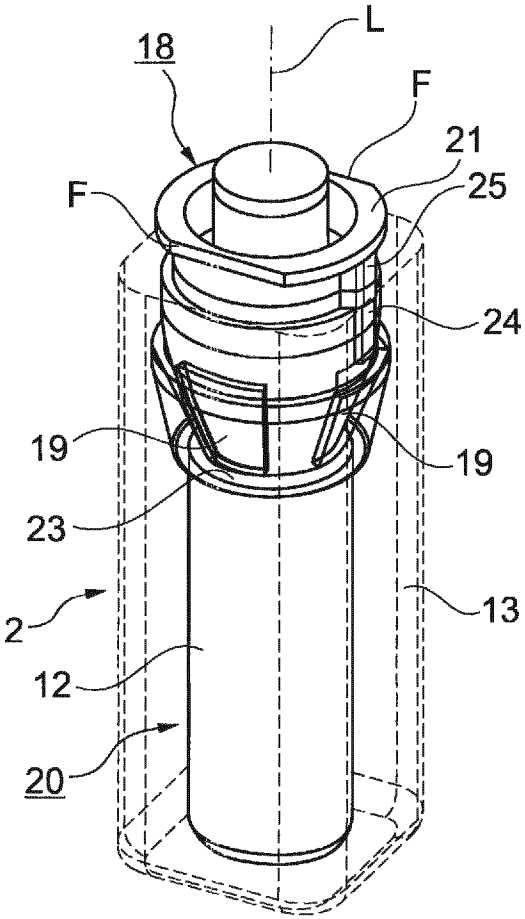
Figure 11:
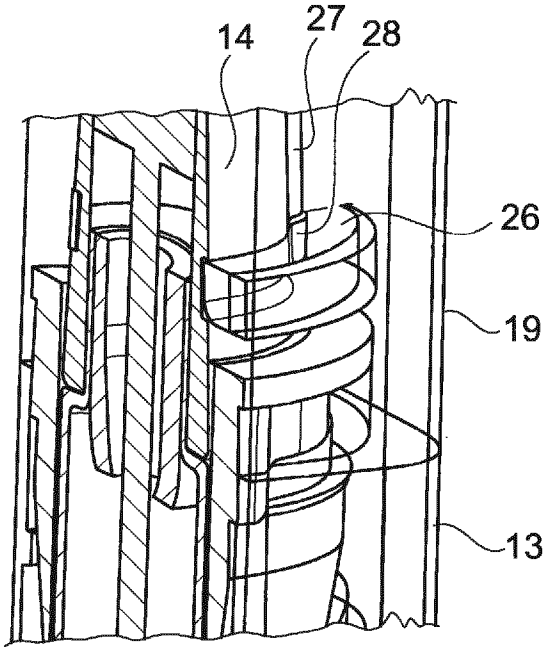
FIG. 11 shows a sectional view through FIG. 10.
Figure 10:
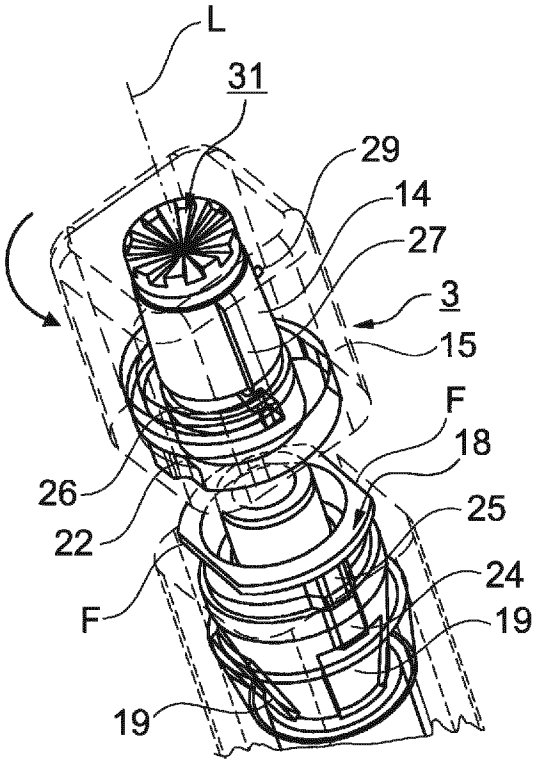
FIG. 10 shows an enlarged portion of FIG. 8 in still closed position.
Figure 9:
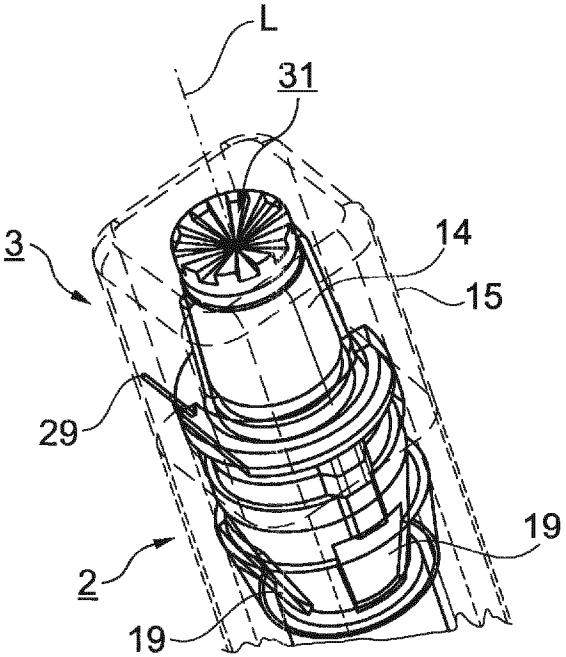
FIG. 9 shows an enlarged portion of FIG. 8 at the moment of the movement of the cap.
Figure 12:
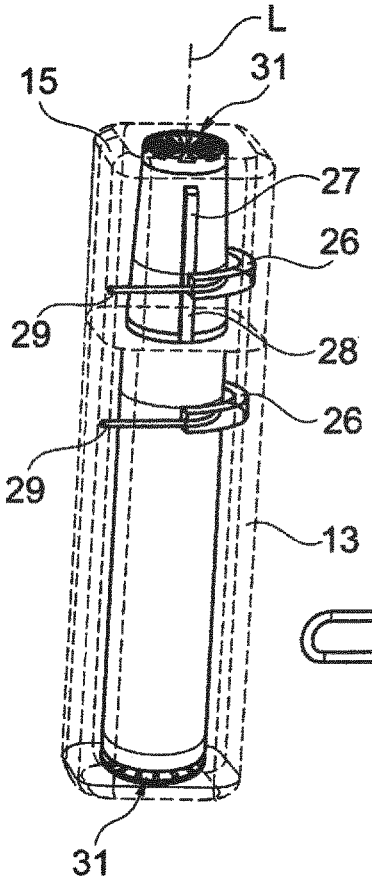
FIG. 12 shows the application unit being equipped with a second locking mechanism in a latched state.

As can be seen best from FIGS. 6 to 8, the cosmetic unit comprises the following parts:

A container 2 which is formed by the tank 12, the lower shell portion 13, and by the actuation collar 18.

A cap 3 is formed by the base body 14 and the upper shell portion 15 and a latching mechanism of whatever nature. The base body 14 carries a rod 16, which is equipped with an applicator 17 at its distal end.

The lower shell portion 13 and the upper shell portion 15 may be designed on their outside as desired by the user. In particular, it is advantageous if the lower shell portion 13 and the upper shell portion 15 are designed that way as disclosed before in connection with FIGS. 1 to 5.

Mandatory for this solution is that the tank 12 is provided with a groove or protrusion that can be used for a positive fit locking by means of the latching flaps 19.

The latching flaps 19 are flexible, so that they are bendable. They protrude obliquely in radial direction into the tank receiving area 20.

An interesting issue is that the collar has—preferably radially protruding—rest means 21 in order to screw or to nest the cap 3 on it. That can be accomplished by bringing the according rest means 21 into engagement with according latching means 22 embodied by the base body 14 itself or by the upper shell portion 15 surrounding the base body 14. For that purpose the cap 3 is (for closing) stuck on the container 2 in a position that its latching means 22 (see FIG. 10) passes the opposite flattenings F (see FIG. 6) until they are positioned below flattening F (see FIG. 8). Starting from the position shown by FIG. 8 the cap is turned (here) in clockwise direction until the latching means nest with the rest means 21 while the indentation of the rest means is preferably elastically snapped over the protrusion 25 (see FIG. 6)

However, that is not yet the full function of the actuation collar 18. This can be seen when considering FIG. 6 in detail.

As soon as one presses the actuation collar 18 down, it works as a remote control means since it begins to contact the latching flaps 19, mostly in their middle area. The more the actuation collar 18 is pressed down the more it presses the latching flaps 19 in radial outward direction. Finally, the latching flaps 19 come out of engagement with the groove 23 or protrusion of the tank 12. Thereupon, the tank 12 can be pulled out of the lower shell portion 13 in upward direction.

It is possible to provide additional means securing the actuation collar 18 against unintentional actuation. This additional means could be for example a vertical slot 24 cooperating with an according protrusion 25 of the actuation collar 18. If the actuation collar is in the position shown by FIG. 6, the vertical slot 24 and the protrusion 25 of the actuation collar 18 are in alignment, that way the actuation collar 18 can be pressed down for remotely unlatching the flaps 19.

The flaps 19 are completely internal and cannot be seen from the outside. The flaps 19 are remotely actuated.

Second Fixing Option

The second alternative for latching is disclosed by FIGS. 12 to 15.

The solution can be applied as well for locking and unlocking the tank against the rigid shell, or for locking and unlocking the base body against the rigid shell.

This solution uses a semi- or partial-circular slider 26, hereinafter abbreviated as "circular slider". The circular slider 26 can slide in a circular groove between the base body 14 and the interior surface of the upper shell portion 15.

The slider 26 is completely internal and cannot be seen from the outside. The slider 26 is remotely actuated.

For purpose of remote actuation, at least one actuation channel 29 is provided. The actuation channel 29 can be used to introduce for example the straight leg of a paperclip or the other kind of activation pin which serves as a remote operator. As can be seen best from FIG. 13, the pin contacts the circular slider 26 (one front face thereof) as soon as it is introduced deep enough.

Now—from functional viewpoint—two alternative functional variants are imaginable and proposed in the frame of this invention.

Figure 15:
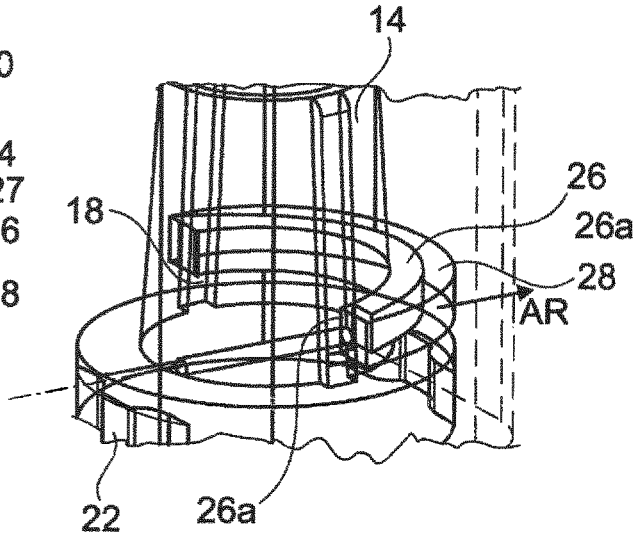
FIG. 15 shows an enlargement of FIG. 14.

The locking and releasing action of the slider 26 can be accomplished as follows (first variant):

The guiding channel 28 for the slider 26 can be at the appropriate position somewhat broader than the slider 26. The slider's end opposite to the actuation channel 29 may be blocked against movement in circumferential direction. The slider can be pushed by means of the actuating pin or by means of the leg of the paperclip in direction of the arrow AR (FIG. 15). That way the slider goes 26 out of engagement with the groove 26*a* which is embodied in the cap's base body 14 and which nested with the slider 26 by now. That way the positive locking between the base body 14 and the shell 15 is released and the base body can 14 be pulled out of the shell 15.

Alternatively (not perfectly sketched) the locking and releasing action of the slider 26 can be accomplished as follows (second variant):

The base body 14 can for example have a protrusion 27. This protrusion 27 is movably held in a groove 28 of the upper shell portion 15. As soon as the circular slider 26 is in its locking position, it blocks for example the groove 28. That way the protrusion 27 of the base body 14 is caught, that is accommodated in the groove 28 above the circular slider 26.

Further pushing of the pin into the channel 29 begins to move the slider 26 along its circular track. That way the slider completely passes the groove 28 so that it is not blocked any more by the slider 26. Now the upper shell portion 15 can be lifted off and separated from the base body 14. In order to latch the upper shell portion 15 again after being positioned on the base body, an according second actuation channel can be provided on the opposite side. After having stuck a pin into this opposite actuation channel, the circular slider can be pushed back into its locking position.

Figure 13:
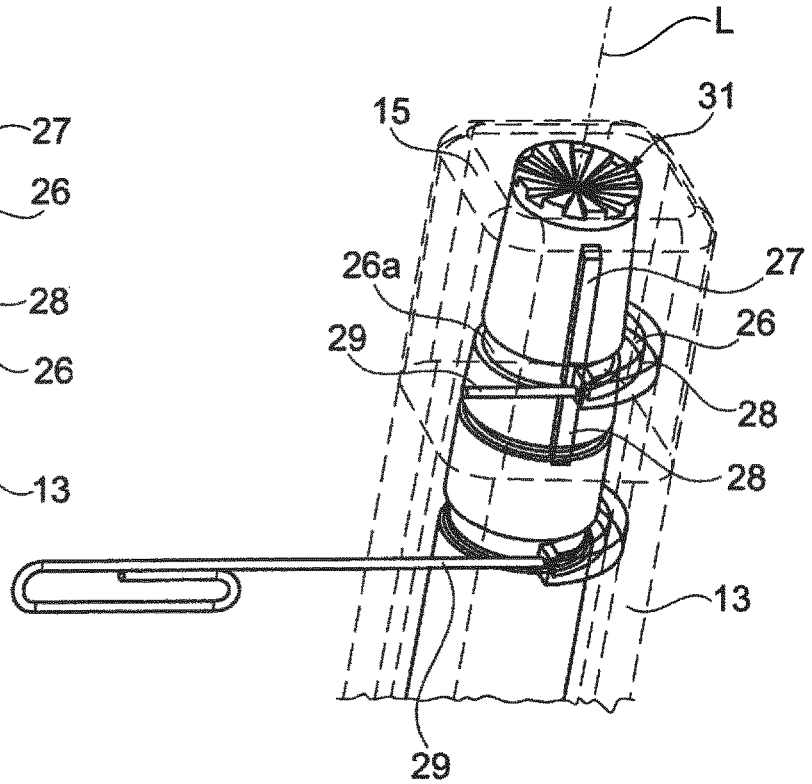
FIG. 13 shows an enlargement of FIG. 12 during unlatching.

As can be seen from FIG. 13, the same mechanisms as sketched before can also be provided for locking and unlocking the tank in the lower shell portion 13, or more precisely said, in its tank receiving area 20.

Figure 14:
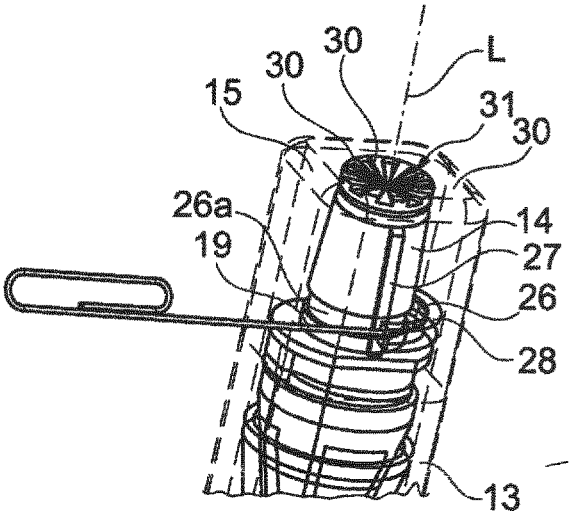
FIG. 14 shows an enlargement of FIG. 13.

A very interesting detail can be seen best when looking into FIG. 14.

The roof of the upper shell portion 15 is constituted by a number of beams 30 which are protruding with their free end into the centre. The beams 30 are slightly curved or inclined in inward direction. Preferably, the beams become continuously slimmer in direction toward their free end, so that they have more or less a triangular shape. The beams form preferably a star-shaped configuration. That way these beams 30 form a spring element 31 being resilient in direction along the longitudinal axis L of the whole cosmetic unit. This spring element 31 exerts a tension against the upper surface of the base body 14. That makes sure that the base body 14 is pushed out of the upper shell portion 15 as soon as the circular slider 26 does not exert a positive fit holding action any more.

The same type of spring element can be provided in the bottom of the lower shell portion 13 for driving the tank out of the tank receiving area 20 of the lower shell portion 13 upon unlocking.

The same type of spring element has already been mentioned in the beginning when discussing FIGS. 2 and 3 without giving closer explanation at that occasion.

Third Fixing Option

Figure 16:
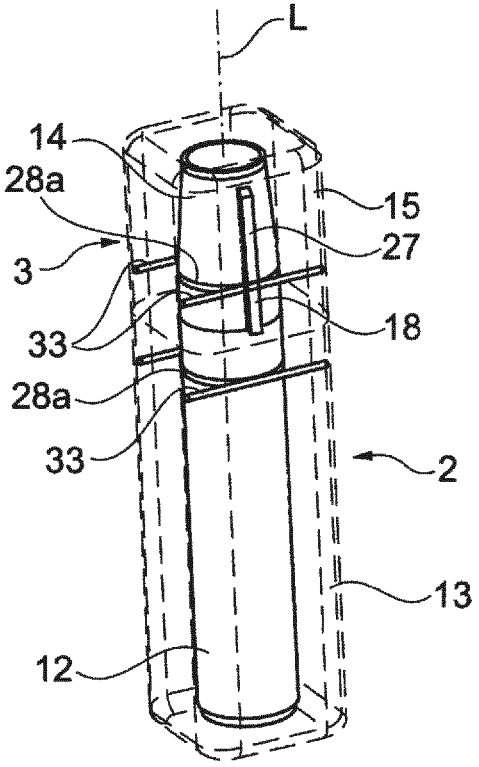
FIG. 16 shows the application unit being equipped with a third locking mechanism in a latched state.
Figure 17:
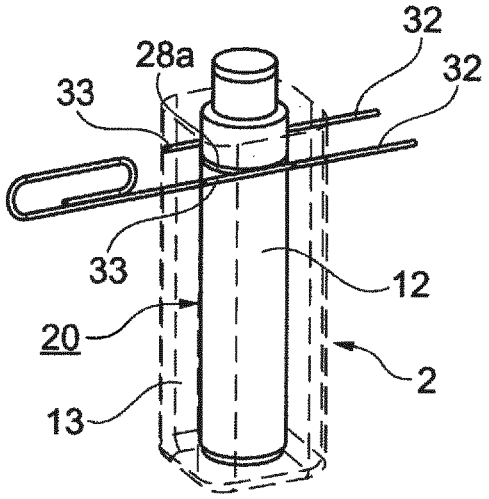
FIG. 17 shows the application unit with a removed cap during unlatching.

The third alternative for fixing is disclosed by FIGS. 16 and 17.

Generally, this fixing method works similar to the one disclosed by means of FIGS. 12 to 15.

Once again, the upper shell portion 15 can have a groove 28 in which a protrusion 27 of the base body 14 is positioned. As soon as the protrusion 27 has (in fully mounted stage) reached its uppermost position, a blocking pin 32 is introduced into the pin containing channel 33. As soon as it is fully introduced, the blocking pin 32 hinders the protrusion 27 from sliding down the grooves 28 so that the upper shell portion 15 and the base body 14 are latched to each other by means of positive fit.

Preferably, according blocking pins 32 and according pin containing channels 33 are provided at both opposite sides. For unlatching purposes another pin or the straight leg of a paperclip is introduced into the pin containing channel 33 in order to drive the blocking pins 32 out. As soon as the straight leg of the paperclip has pulled out again after having driven out both blocking pins 32, the latching between the upper shell portion 15 and the base body 14 is released.

For sake of completeness it has to be mentioned that this kind of locking worked even if no protrusion 27 word be provided. In this case the groove 28 nests with the pin 32 providing thereby for positive fit locking.

As shown by FIG. 17, the same mechanism can be used for latching the tank 12 within the tank receiving area 20 of the lower shell portion 13.

Fourth Fixing Option

Figure 18:
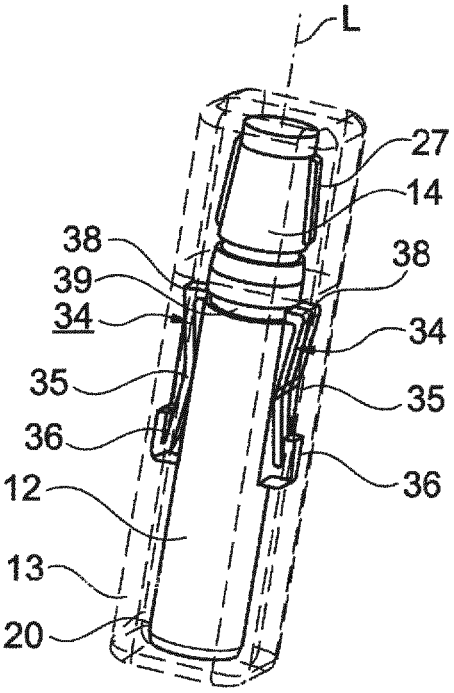
FIG. 18 shows the application unit being equipped with a fourth locking mechanism in a latched state.
Figure 19:
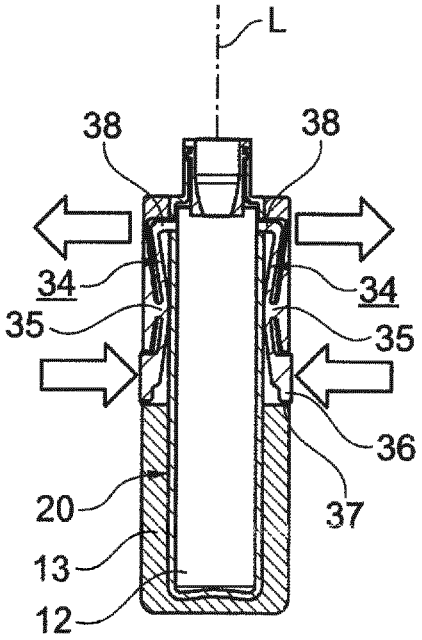
FIG. 19 shows the application unit according to FIG. 18 during unlatching, with the cap already removed.

The fourth alternative for fixing is disclosed by FIGS. 18 and 19.

This method is preferably used for latching the tank 12 within the tank receiving area 20 of the lower shell portion 13. However, generally it is possible to use the same construction for latching the base body 14 within the upper shell portion 15.

Here, a hidden rocker beam 34 is provided inside or close to the tank receiving area 20. The rocker beam 34 can be, preferably in the elastic manner, swivelled around a rocker post 35.

At one of its ends the rocker beam 34 forms an actuation pad 36. This actuation pad 36 protrudes through a rocker window 37 through the wall of the lower shell portion 13. That way it can be pressed down from the outside. On its opposite end the rocker beam 34 forms a locking tooth 38. The locking tooth 38 protrudes into a groove 39 formed in the jacket of the tank, see FIG. 18. That way the tank is latched by positive fit.

As soon as one presses down the opposite actuation pads 36, the rocker beams 34 are swivelled. That way the latching teeth 38 come out of engagement with the groove 39. Consequently, the tank is unlatched. It can now be pulled out in upward direction. In case that the bottom is provided with a spring element (not shown here), the tank will move automatically in upward direction for the amount necessary in order to hinder unwanted re-latching.

In other words: Even here the actuation pad 36 forms a kind of remote control means for actuating the latch holding the tank.

For that purpose the rocker beam 34 is completely positioned inside of the shell 15, except for the actuation pads 36. It is not difficult to see that the rocker beam 34 forms an undercut on the interior of the lower shell portion 13, which is difficult to manufacture by means of injection moulding. Therefore, even this construction is preferably bound for 3D-printing.

Fifth Fixing Option

Figure 20:
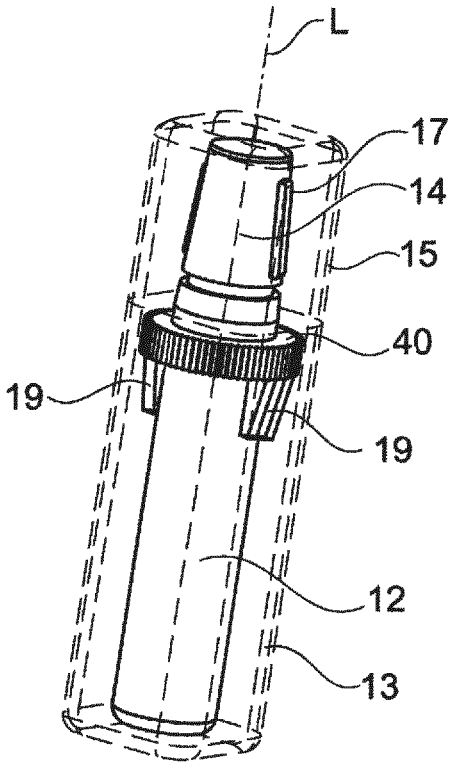
FIG. 20 shows the application unit being equipped with a fifth locking mechanism in a latched state.
Figure 21:
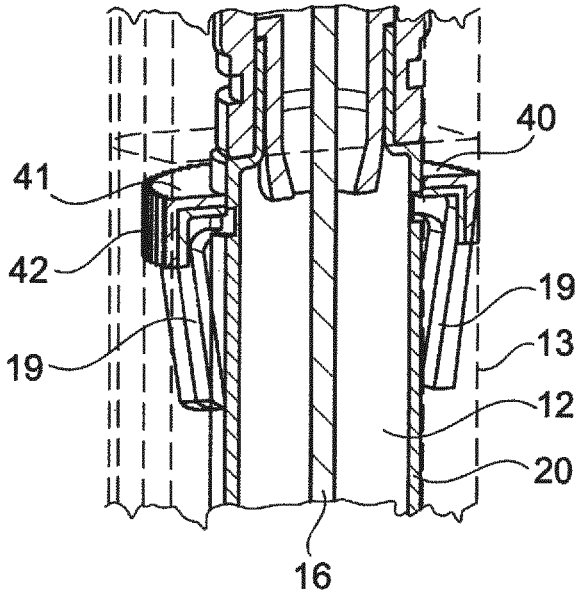
FIG. 21 shows an enlargement of FIG. 20.
Figure 22:
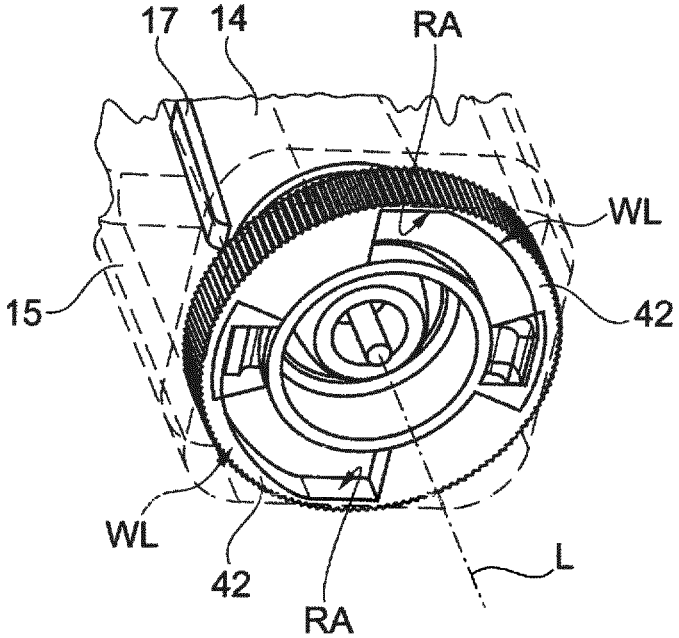
FIG. 22 shows a top view onto an enlargement of FIG. 20.

The fifth alternative for fixing is disclosed by FIGS. 20, 21 and 22.

Here the lower shell portion 13 is provided with a rotatable collar 40. This collar 40 can be rotated around the longitudinal axis L of the whole cosmetic device including the longitudinal axis of the container 2.

The collar may have an L-shaped cross-section with a ring portion 41 extending in radial direction and a skirt portion 42 extending coaxially along the longitudinal axis L, see FIG. 21.

The skirt portion 42 protrudes over the elastic flaps 19, which are designed in a similar way as described above for the first embodiment of the latching.

The collar 40 can be rotated between two extreme positions. In the released position the rotatable collar 40 exerts no pressure onto the elastic flaps 19 since the flaps protrude into the widened "release ara" RA of the collar 40. That way the elastic flaps 19 do not exhibit a latching interaction with the according protrusion or grooves in the tank 12.

As soon as the rotatable collar 40 is turned in its locking position, it exerts pressure onto the elastic flaps 19, preferably by means of wedge-like surface segments WL being provided at the inner circumference of the skirt portion 42 and/or at the inner surface of the ring portion.

Under the influence of said pressure the flaps 19 are pivoted into radial inward direction. Now they exhibit a latching interaction with the according protrusion or grooves in the tank 12.

At its outer circumference, the rotatable collar 40 may have a knurled surface. This knurled surface may extend through a window in the lower shell portion 13, so that it can be turned from outside by pressing a finger on the knurled surface and turning it while the major part of the rotatable collar 40 is concealed by the shell.

Again a remote actuation is realized.

Sixth Fixing Option

Figure 23:
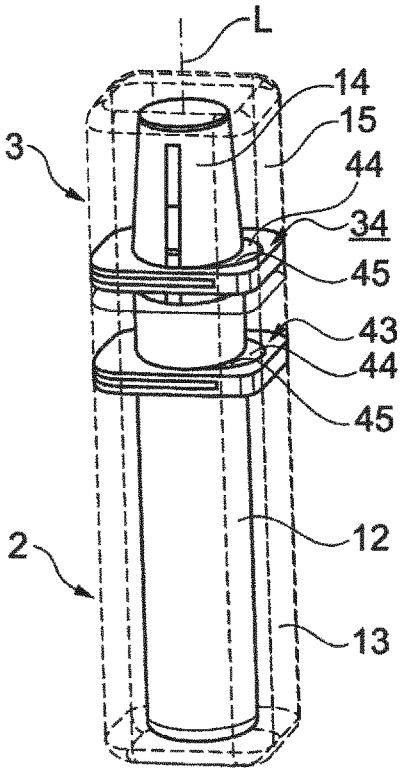
FIG. 23 shows the application unit being equipped with a sixth locking mechanism in a latched state.
Figure 24:
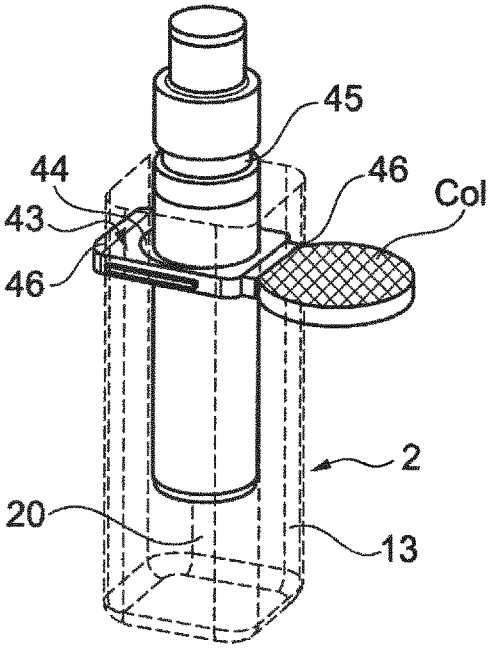
FIG. 24 shows the application unit according to FIG. 23 in an unlatched state.

The sixth alternative for fixing is disclosed by FIGS. 23 and 24. This fixing can be used any way for latching the tank 12 within the lower shell portion 13 and for fixing the base body 14 within the upper shell portion 15.

It is explained hereinafter in regard to the lower shell portion.

As one can see, there is a parallel slider plate 43. This can be slid along a horizontal slot. The said slot extends through the lower shell portion 13.

The slider plate 43 is equipped in its middle area with an oversized breakthrough 44 having a diameter bigger than the outer diameter of the tank 12. As one can see, the tank 12 has a groove 45, which is so broad that the slider plate 43 can be slid into it in radial direction.

If the slider plate 43 is in the position shown by FIG. 23, its one side protrudes into the groove 45 of the tank 12. That way the tank 12 is latched against movement in longitudinal direction L.

The slider plate is accessible through both lateral windows 46 of the lower shell portion 13. That way it is possible, for example, to press with a coin or pin onto the parallel slider plate 43 in order to move it into the position shown by FIG. 24. In this position the parallel slider plate 43 does not engage the groove 45 of the tank 12 anymore. For that reason, the tank 12 is free now and can be pulled out of the shell portion 13, as shown by FIG. 24.

After having stuck another tank 12 into the lower shell portion 13, for example a fresh one, it is no problem to press onto the left-hand side of the parallel slider plate 43, which protrudes through the lateral window 46 over the jacket surface of the shell portion 13.

That way the parallel slider plate 43 can be moved back into its latching position. As soon as the parallel slider plate 43 is back in this position, it does not protrude any more over the jacket surface of the shell portion 13.

Figure 25:
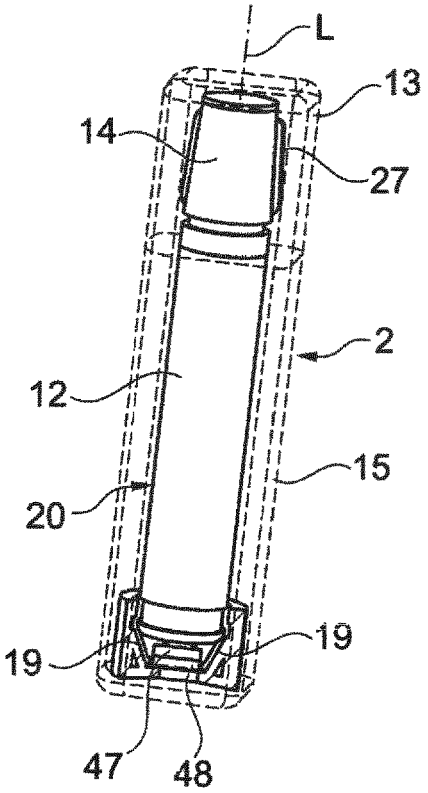
FIG. 25 shows the application unit being equipped with a seventh locking mechanism in a latched state.
Figure 26:
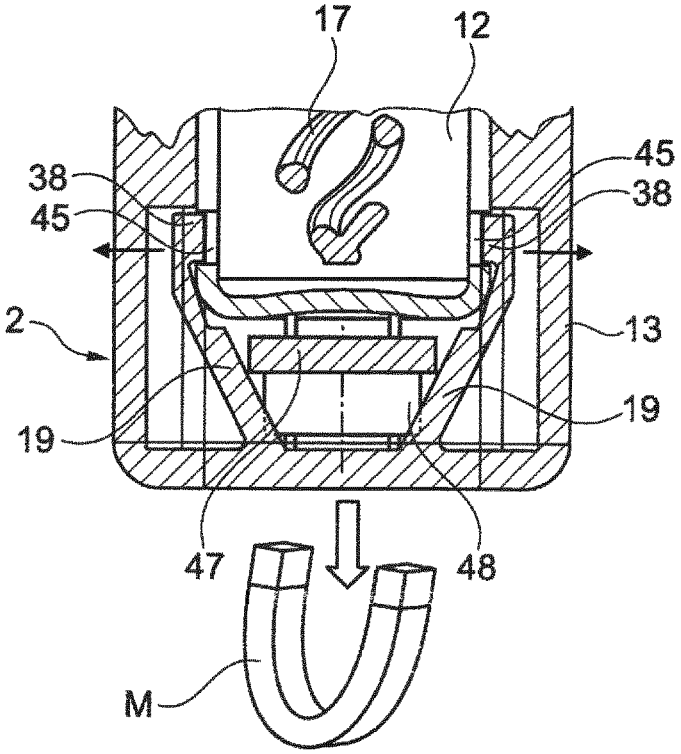
FIG. 26 shows an enlarged partial view of FIG. 25.
Figure 27:
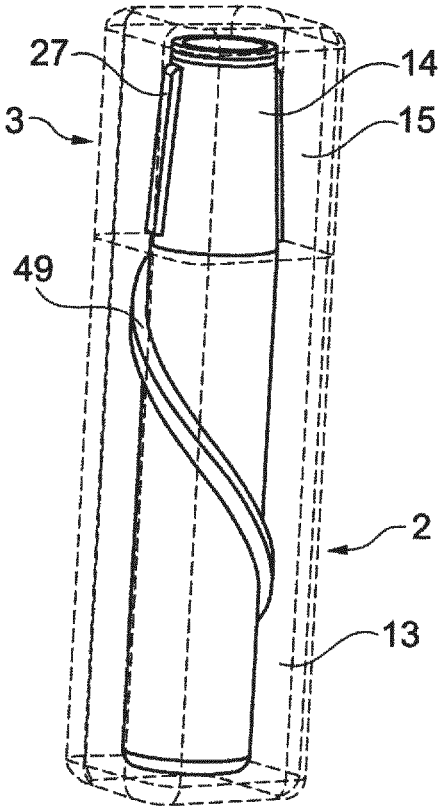
FIG. 27 shows the application unit being equipped with the eighth locking mechanism in a latched state.

The seventh alternative for fixing is disclosed by FIGS. 25 and 27. This fixing can be used any way for latching the tank 12 within the lower shell portion 13 and for fixing the base body 14 within the upper shell portion 15.

For this purpose, at least two preferably elastic flaps 19 are provided. The flaps 19 can carry a locking tooth 38 at their free ends. The locking tooth 38 protrudes into a groove 45 of the tank 12.

A preferably magnetic or metallic actuator 47 can be provided. Upon application of a magnetic field, it can move or spread the preferably flaps 19 (preferably arranged in V-formation) from their locking position into their releasing position. The magnetic field is the means for remote control of the hidden locking mechanism, which is again fully inside of the lower shell portion 13.

It is a very preferred embodiment to arrange the flaps 19 in a cone-like configuration. In the centre of the cone-like configuration the metallic actuator is hold, so that it can move up and down. Preferably, for that purpose the metallic actuator 47 is provided with a guide element 48, which may, for example, be positioned in a guiding manner between the interspaces of the flaps 19 that are adjacent to each other in circumferential direction.

As soon as this actuator 47 is, for example, pulled down by means of magnetic forces, it wedges the flaps 19 in radial outward direction, so that they swivel into their unlocked position.

Eighth Fixing Option

Figure 28:
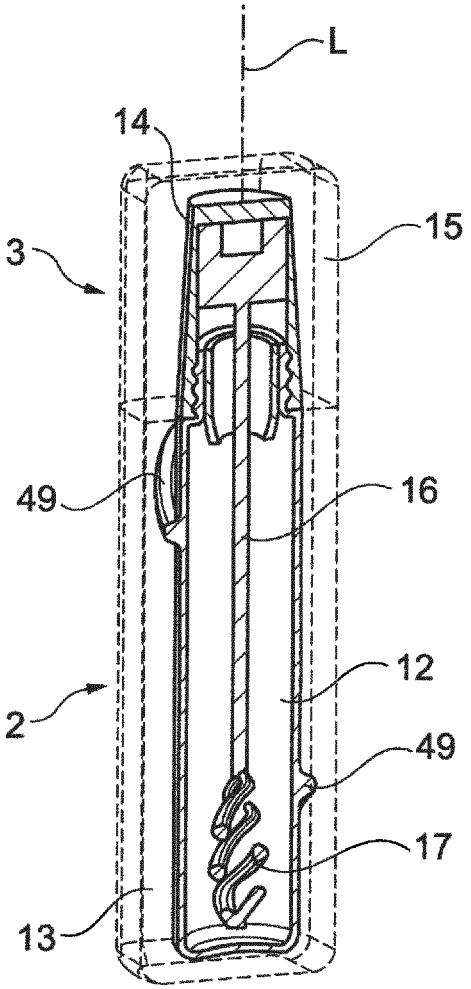
FIG. 28 shows a longitudinal cross section through FIG. 27.

The eighth alternative for fixing is disclosed by FIGS. 27 and 28.

Here, it is provided that the tank carries a thread 49, preferably a male thread. The counter-thread is carried by the lower shell portion 13.

The orientation of this thread 49 is preferably that way that the thread 49 will "drive" the tank 12 out of the lower shell portion 13 if sufficient twist is exerted after the cap has already reached its closed, tight position.

Preferably, an additional snap-in mechanism (not shown) is provided, so that the thread cannot be unintentionally operated. Such an additional snap-in mechanism requires a remarkable "over-twist" in order to overcome and to move the thread hereinafter in a substantial manner.

The same purpose can be reached if the thread is equipped with a certain kind of wedging or jamming action so that it needs remarkable forces for being actuated, that means an intensive twist which is normally not applied unintentionally.

It has to be mentioned that the different alternative fixing methods can be combined with each other. It is not mandatory that the cap uses the same fixing arrangement as the tank.

Miscellaneous

In the framework of the invention there is a method, for which protection is claimed, too.

What is claimed is a method of producing a cosmetic unit comprising a container filled with a flowable cosmetic that can be removed through an access opening of the container, and a cap (3) for closing the access opening of the container (2), whereas the cap (3) carries an applicator (17),

A digital model is generated for an outer shell of the cosmetic unit.

The digital model is provided with an inner space for the accommodation and fixation of a cosmetic tank and, optionally, a base body for forming a cap, the material for the outer shell is conditioned in a raw form in which it is capable of flowing, the material in the raw form is solidified by means of a light or heat source in slices that are defined by the digital model that way forming a shell, already during solidifying or after completion of solidifying at least a tank is stuck into the shell and fixed there, preferably by actuating a latch establishing a positive interlocking between the tank and the shell, preferably before, synchronously or hereinafter a base body carrying, preferably by means of an intermediate stem, an applicator portion is stuck into the shell and fixed there, preferably by actuating a latch establishing a positive interlocking between the base body and the shell accommodation it.

Preferably the tank and the base body are tightly fixed to each other during mounting of the shell.

LIST OF REFERENCE NUMBERS

1 cosmetic unit
2 container
3 cap
4 ornamental design
5 inner portion of the shell
6 outer portion of the shell
7 beam
8 node
9 window
10 cut
11 button
12 tank
13 lower shell portion
14 base body
15 upper shell portion
16 rod
17 applicator
18 actuation collar
19 flap
20 tank receiving area
21 rest means
22 latching means
23 groove
24 vertical slot
25 protrusion
26 circular slider

26*a* groove for slider 26 in the base body 14 or the tank 12
27 protrusion
28 groove
29 actuation channel
30 beam
31 spring element
32 blocking pin
33 pin containing channel
34 rocker beam
35 rocker post
36 actuation pad
37 rocker window
38 locking tooth
39 groove
40 rotatable collar
41 ring portion
42 skirt portion
43 parallel slider plate
44 breakthrough
45 groove
46 lateral window
47 metallic actuator
48 guide element (mostly skirt-like)
49 thread
L Longitudinal axis of the whole device
LL Longitudinal axis of a beam 7
D radial distance of a beam
F flattening of the locking collar 18
AR arrow of slider's 26 movement in radial outward direction
RA widened area of the ring 40
WL wedge like section of the ring 40

The invention claimed is:

1. A cosmetic unit comprising:

a container filled with a flowable cosmetic that can be removed through an access opening of the container, wherein the container is formed by a tank made of cosmetic compatible material and a rigid outer shell surrounding at least the tank, wherein the shell has no closed bottom below the tank; and a cap for closing the access opening of the container, wherein the cap carries an applicator;

wherein the tank carries a thread and the shell carries a counter-rotating thread, which presses the tank out of the shell when the cap is over-turned and after overcoming resistance.

2. The cosmetic unit according to claim 1, wherein said shell shows a macroscopic texture of solid particles fused together.

3. The cosmetic unit according to claim 1, wherein the shell forms a framework with interspaces through which the tank can be seen from outside, while the tank is transparent or translucent.

4. The cosmetic unit according to claim 1, wherein the outer shell is printed onto the tank serving as a base structure for 3D-printing.

5. The cosmetic unit according to claim 4, wherein a wall of the container is thick enough to bear local melting by a laser beam, and a surface material of the container and a 3D-printing granulate are matched to one another so that the surface material and the 3D-printing granulate fuse if locally melted altogether.

6. The cosmetic unit according to claim 1, wherein the tank forms a bottleneck for holding said cap in a fluid tight position, and the cap carries a rigid outer shell.

7. The cosmetic unit according to claim 1, wherein an interconnection between the tank and the shell and/or the cap and the shell is a form fit latching that can be locked and released by a user without leaving any traces or scratches on the cosmetic unit.

8. The cosmetic unit according to claim 7, wherein the form fit latching is realized by at least one internally hidden latch which is remotely actuated.

9. The cosmetic unit according to claim 8, wherein the shell is equipped with an actuation channel or hole through which a pin or rod can be introduced into the shell for contacting and operating said at least one internally hidden latch, or the shell is equipped with a movable shell portion in the shape of a movable collar or slider that can be moved deeper into the shell for contacting and operating said at least one internally hidden latch.

10. The cosmetic unit according to claim 1, wherein the shell is equipped with a movable shell portion in the shape of a movable collar or slider that can be moved as a whole relative to the rest of the shell, that way acting as an internally hidden latch.

11. The cosmetic unit according to claim 1, wherein the shell is equipped with a rotatable collar that can be turned as a whole between a position releasing a latch and a position pressing onto a latch.

12. The cosmetic unit according to claim 1, wherein the thread further comprises a snap-in mechanism, and wherein the counter-rotating thread on the shell presses the tank out of the shell when the cap is over-turned and after overcoming resistance from the snap-in mechanism.

13. The cosmetic unit according to claim 1, wherein the thread further comprises a wedging or jamming mechanism, and wherein the counter-rotating thread on the shell presses the tank out of the shell when the cap is over-turned and after overcoming resistance from the wedging or jamming mechanism.

* * * * *